United States Patent [19]

Haneda et al.

[11] Patent Number: 4,792,512

[45] **Date of Patent: * Dec. 20, 1988**

[54] METHOD OF DEVELOPING ELECTROSTATIC IMAGES USING TWO COMPONENT DEVELOPER AND AC CHARGING

[75] Inventors: Satoshi Haneda, Hachioji; Takashi Itoh, Tokyo; Ken Nakamura; Makoto Tomono, both of Hino, all of Japan

[73] Assignee: Konishiroku Photo Industry, Co., Ltd., Tokyo, Japan

[ * ] Notice: The portion of the term of this patent subsequent to Jun. 23, 2004 has been disclaimed.

[21] Appl. No.: 64,211

[22] Filed: Jun. 19, 1987

Related U.S. Application Data

[60] Continuation of Ser. No. 833,439, Feb. 24, 1986, Pat. No. 4,675,267, which is a continuation of Ser. No. 588,095, Mar. 9, 1984, abandoned, which is a division of Ser. No. 349,999, Feb. 18, 1982, Pat. No. 4,450,220.

[30] Foreign Application Priority Data

| | | | |
|---|---|---|---|
| Feb. 25, 1981 | [JP] | Japan | 56-25390 |
| Feb. 25, 1981 | [JP] | Japan | 56-25391 |
| Feb. 25, 1981 | [JP] | Japan | 56-25392 |
| Feb. 25, 1981 | [JP] | Japan | 56-25393 |
| Mar. 9, 1981 | [JP] | Japan | 56-32417 |
| Mar. 9, 1981 | [JP] | Japan | 56-32418 |
| Mar. 9, 1981 | [JP] | Japan | 56-32419 |
| Mar. 9, 1981 | [JP] | Japan | 56-32420 |
| Mar. 9, 1981 | [JP] | Japan | 56-32421 |
| Mar. 9, 1981 | [JP] | Japan | 56-32422 |

[51] Int. Cl.[4] ..... G03G 13/08; G03G 13/09; G03G 13/22

[52] U.S. Cl. ..... 430/102; 430/122

[58] Field of Search ..... 430/102, 122, 101, 120

[56] References Cited

U.S. PATENT DOCUMENTS

| | | | |
|---|---|---|---|
| 3,346,475 | 10/1967 | Matkaz | 430/103 |
| 3,826,672 | 7/1974 | Cantarano | 430/102 X |
| 3,890,929 | 6/1975 | Walkup | 355/3 DD X |
| 4,076,857 | 2/1978 | Kasper et al. | 430/122 X |
| 4,309,498 | 1/1982 | Yamashita et al. | 430/122 X |
| 4,447,517 | 5/1984 | Yuge et al. | 430/122 |

*Primary Examiner*—Roland E. Martin

*Attorney, Agent, or Firm*—James E. Nilles; Thomas F. Kirby; Donald C. McGaughey

[57] ABSTRACT

A charging method of an electrostatic image developer which makes it possible to electrically charge an insulating one-component developer or a two-component developer consisting of a toner and a carrier to a desired charged state and which comprises introducing the developer into a charging space between a pair of sheet-like charging members opposing each other in which space an alternating field is formed, and oscillating the developer by means of the alternating field for charging it. A developing method of a non-contact or contact system which develops the electrostatic image by use of the developer charged electrically by the above-mentioned charging method.

8 Claims, 8 Drawing Sheets

METHOD OF DEVELOPING ELECTROSTATIC IMAGES USING TWO COMPONENT DEVELOPER AND AC CHARGING

This application is a continuation of application Ser. No. 833,439 filed Feb. 24, 1986 now U.S. Pat. No. 4,675,267 which is a continuation of Ser. No. 588,095 filed Mar. 9, 1984 now abandoned which is a division of Ser. No. 349,999 filed Feb. 18, 1982 now U.S. Pat. No. 4,450,220.

BACKGROUND OF THE INVENTION

1. Field of the Invention

This invention relates to a method of treating an electrostatic image in order to electrically charge and develop the electrostatic image that is formed in electrophotographic process, electrostatic recording process, electrostatic printing process, and so forth.

2. Description of the Prior Art

As the systems for developing an electrostatic image to form a visible image, a wet developing system using a liquid developer and a dry developing system using a powder developer are generally known. The latter, which is a dry process and is advantageous because plain paper is usable, is further classified broadly into a system using a two-component developer consisting of a carrier and a toner and a system using a one-component developer consisting of the toner alone.

In comparison with the system using the two-component developer, the developing system using the one-component developer is more advantageous because the change in the toner concentration does not occur in itself, resulting in simplification of a developing means and because the characteristics of the developer does not deteriorate but remains stable over an extended period. However, this system is not devoid of the critical drawback in that a stable image-forming property cannot be obtained. This is because it is difficult to electrically charge the one-component developer in a desired state.

In order to obtain a satisfactory visible image by the dry developing system, it is essentially necessary to electrically charge the toner in a necessary polarity and moreover, in a suitable charge quantity. In the system using the two-component developer, on the other hand, the toner is frictionally charged while the toner and the carrier are being mechanically stirred so that the charge polarity and charge quantity of the toner can be somehow controlled by selecting such conditions as the carrier characteristics, the stirring condition, and so forth. In the one-component developer consisting of the toner alone, however, no such carrier exists and hence control of the charge polarity and charge quantity of the toner is extremely difficult.

As the methods of charging the one-component developer, there have been conventionally known a frictional charging method which agitates the developer by means of a mechanical force, a charge-injection charging method using injection electrodes and a charging method using a corona discharger.

In the frictional charging method, the toner is charged by friction between the toner and the stirrer, between the toner and the vessel wall or between the toner particles by themselves. Accordingly, this method involves the problems that the charge quantity is generally small, control of the charge quantity is difficult and toner is partially charged opposite to the required polarity.

In the charge injection charging method, charge injection becomes difficult if the developer is dielectric, and leak would occur if the developer is conductive, on the contrary, whereby a large charge quantity cannot be obtained.

In the charging method using a corona discharger, there are problems that the developer cannot be uniformly charged and the corona wire is likely to be contaminated.

Thus, it has not been possible in accordance with the conventional methods to charge a one-component developer in a suitable charged state and consequently, extremely strict conditions must be employed in the developing method using a one-component developer. Nonetheless, it has been difficult to stably form a satisfactory visible image and the corona wire has been likely to be contaminated.

On the other hand, various means have been known in the past in order to let the electrically charged one-component developer act upon a support supporting thereon an electrostatic image to form a visible image, by utilizing essentially the electrostatic attraction of the electrostatic image. (The means will hereinafter be referred to as the "developing means".) The developing means are broadly classified into a contact developing system which brings a developer into contact with the entire surface of an electrostatic image support as typified by an impression system, and a non-contact developing system such as a jumping system or a touch-down system in which development is effected while the developer is not brought into contact with the entire surface of the electrostatic image support.

In the non-contact developing system, the toner is caused to jump from a developer support to the electrostatic image support placed so as to oppose the former, thereby effecting development. Accordingly, the toner must have a considerably large charge and in addition, it is essentially necessary that the thickness and surface condition of the toner layer supported on the developer support be uniform.

The contact developing system is preferable because it makes it possible to deposit the toner on the electrostatic image in a reliable manner. Since the developer is brought into contact also with non-image portions where no electrostatic charge exists, however, the toner is highly likely to attach to such portions. It is therefore necessary that the charge quantity of the toner supported on the developer support be uniform. In the impression system or the like, further, the thickness and surface condition of the layer formed by the toner must be uniform. Otherwise the toner attaches also to the non-image portions on the electrostatic image support so that a clear visible image cannot be obtained after all.

In development by use of the one-component developer, may it be the contact developing system or the non-contact developing system, it is desired that the developer is introduced into the developing region, or the region in which the charged one-component developer is permitted to act upon the electrostatic image support, in the minimal quantity required for development. For, unlike the two-component developer, all the one-component developer that have been introduced have the possibility of participating in the development. The minimal necessary quantity means the quantity in the state in which several layers of the developer particles are deposited.

According to the conventional methods, however, it has not been possible not only to obtain the necessary charge polarity and charge quantity for the one-component developer, as described already, but also to introduce the charged developer into the developing region under the desirable state. For these reasons, it has been difficult to stably form the satisfactory visible image.

In the developing system using the two-component developer, the toner and the carrier are mechanically stirred so as to frictionally charge the toner for visualizing the image. Hence, control of the charge polarity and charge quantity of the toner is possible to a considerable extent by selecting the carrier characteristics, the stirring conditions and the like, thus providing a satisfactory visible image. Due to this advantage, the developing system using the two-component developer has gained a wide application in practice.

In the system using the two-component developer, it has been a practice to mechanically stirr the developer in order to electrically charge the developer. For this reason, a stirring mechanism having a large torque is necessary. Moreover, the carrier is likely to be broken and degradation of the developer as exemplified by "toner filming" occurs. Especially when development is carried out at a high speed or when the developing step is continuously repeated a large number of times, these result in the critical problem.

SUMMARY OF THE INVENTION

In view of the background described above, the present invention is directed to provide a charging method of an electrostatic image developer which makes it possible to electrically charge an insulating one-component developer or a two-component developer consisting of a toner and a carrier to a desired charged state and also a method of developing an electrostatic image which makes it possible to accomplish excellent development.

These objects can be accomplished by a charging method which comprises introducing an insulating one-component developer or a two-component developer consisting of a toner and a carrier into a charging space between a pair of sheet-like charging members opposing each other in which space an alternating field is formed, and oscillating the developer by means of the alternating field for charging it, and also by a developing method of a non-contact or contact system which develops the electrostatic image by use of the developer charged electrically by the above-mentioned charging method.

These and other objects, features and advantages of the present invention will become more apparent from the following description when taken in conjunction with the accompanying drawings.

DESCRIPTION OF THE PREFERRED EMBODIMENTS

Figure 1:
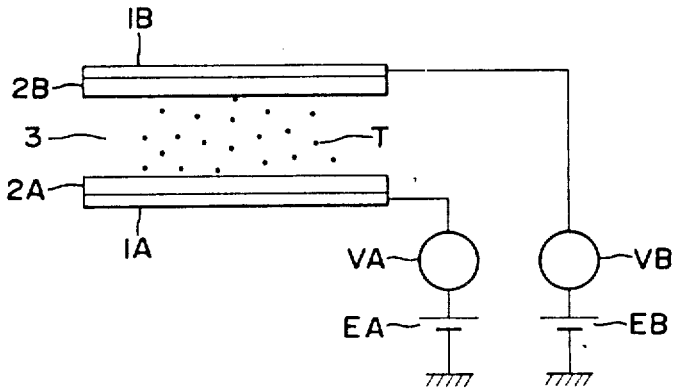
FIG. 1 is a schematic sectional view showing the fundamental construction of a charging device used for the charging step in the electrostatic image developing method of the present invention.

In the present invention, a pair of electrode plates 1A and 1B are arranged so as to oppose each other and sheet-like charging members 2A and 2B are disposed so as to extend along the opposing surfaces of the electrode plates 1A and 1B and to oppose each other, as shown in FIG. 1. Thus, a charging space 3 is defined between these members 2A and 2B. Alternating power sources VA and VB are connected to the electrode plates 1A and 1B, respectively, so as to generate an a.c. field in the charging space 3 and to form a charging device. In general, various types of a.c. field can be used such as rectangular type, pulse type, sine curve type and so on. An insulating one-component developer (hereinafter referred to as the "toner T") or a two-component developer consisting of the toner and a carrier is introduced into this charging space 3, and the a.c. field generated by the operation of the a.c. voltage from the a.c. power sources VA, VB between the electrode plates 1A, 1B, or in the charging space 3, is permitted to act upon the toner T. In this manner, the particles of the toner T are oscillated and are electrically charged by the a.c. field, thereby forming a toner cloud in the charging space 3. The toner thus charged develops the electrostatic image.

In the above-mentioned procedures, it is preferred that d.c. power sources EA, EB are further connected to the above-mentioned a.c. power sources VA, VB in order to superpose the d.c. voltage on the a.c. voltage.

In the method of the present invention described above, it is believed that the toner or the two-component developer is electrically charged in accordance with the following mechanism. Namely, since the toner T or the toner T and the carrier C are in the granular or powdery form, they are believed to be slightly charged in the natural state. Even if they are not charged at all, they are electrically charged due to the mutual friction of the particles or due to the friction of the particles with the wall of the device or the like when they are introduced into the charging space 3. Needless to say, this charge quantity is not so much as to affect the behavior of the particles of the toner T.

However, since the toner T or the toner T and the carrier C are thus charged even slightly, a Coulomb force acts upon the toner T or the toner T and the carrier C when the electric field acts upon them. Because the a.c. field acts upon them in the charging space 3 in accordance with the present invention, the toner T or the toner T and the carrier C are oscillated in accordance with the alternating oscillation of the electric field. In other words, in the half period of the a.c. voltage, the particles jump towards the electrode plate 1A or 1B inside the charging space 3 and impinge against the charging member 2A or 2B. In the subsequent half period, they jump in the opposite direction and impinge against the charging member 2A or 2B, thereafter repeating the same behavior. The cloud is formed under this state. Due principally to the friction when the particles impinge against the charging member 2A or 2B, or due to the mutual friction during jumping, the particles are electrically charged.

In the above-mentioned behavior, the charge polarity of the toner T is determined by the relation in the frictional charge sequence between the material of the charging members 2A, 2B, the material of the carrier C and the toner T. If the carrier C is provided with the primary charging capacity by suitably selecting the material of the charging members 2A, 2B and that of the carrier C, the same relative sequence relation is established for the toner T and the toner T can be charged in a desired polarity. The charging members 2A, 2B may as well have the charging capacity for the toner only as a result. Accordingly, only one of the charging members 2A, 2B or their part may contribute to charging. Since the d.c. voltage is superposed with the a.c. voltage for generating the a.c. field is described already, the toner particles that have been charged in a predetermined charge quantity are attracted and adsorbed by the charging member 2A or 2B that has come to be possessed of a relatively opposite polarity to that of the toner T and consequently, the charging operation is not effected any more for these toner particles. After all, the charge quantity of the toner T can be controlled and the charged toner layer can be formed on the desired charging member 2A or 2B by making use of the attraction to the toner generated by rendering the polarity of the d.c. voltage opposite the charge polarity of the toner or by making use of the electric force of repulsion to the toner generated by rendering the polarity of the d.c. voltage the same as that of the charged polarity of the toner. Moreover, the thickness of the charged toner layer formed in this manner becomes uniform because it is formed as a result of the toner oscillation.

It is practically necessary that at least a part of the opposed surface of each charging member 2A, 2B be made of an electrically conductive material. If this requirement is satisfied, electric equilibrium can be maintained between the charge of the toner and the charge generated on the charging members 2A, 2B or on the carrier. As a result, in those developing system in which the toner is consumed, deposition of the charge on the charging members 2A, 2B can be prevented and the desired behavior of the toner is not restricted. From these aspects, it is possible to construct the charging members 2A and 2B by a metal and to connect the electrode plates 1A and 1B to these charging members, respectively, and it is also possible to delete the electrode plates 1A and 1B by furnishing the charging members 2A, 2B also with the function of the electrodes for generating the a.c. field. In order to avoid the electric condition between the charging members 2A and 2B in such a case, the concentration of the insulating toner in the developer is increased, if the carrier is conductive, so as to have the developer dielectric as a whole, or an insulating carrier is to be employed. As the insulating carrier, the carrier consisting of an insulating material such as glass beads or those carriers which consist of a magnetic or an electrically conductive nucleus whose surface is coated with an insulating resin, can be employed.

In the above-mentioned charging process, the toner is oscillated and electrically charged by the operation of the a.c. field inside the charging space 3 so that the toner particles introduced into the charging space are subjected to the substantially uniform operation of the a.c. field and are charged with a high level of uniformity. Especially when the charging members 2A, 2B are disposed parallel to each other so as to have the thickness of the charging space 3 uniform, the equivalent charging operation can be effected at any position inside the charging space 3 and the uniformity of toner charging can be secured.

In the charging process, the number of impingements per unit time and impinging speed of the toner particles against the charging members 2A, 2B depend upon the frequency and voltage of the a.c. power sources VA, VB that generate the a.c. field inside the charging space 3. Accordingly, if the frequency and voltage are controlled, the charging speed or charge quantity of the toner within a predetermined charging period can be eventually controlled in an easy manner and the charge quantity required for the development of the electrostatic image can be obtained within a short period, for example. As the charged toner layer can be formed on the desired charging member and its maximum charge quantity can be controlled by superposing the d.c. voltage on the a.c. voltage as described already, the toner of a desired charge quantity can be obtained within a short period by using these means.

The toner to be used in the method of the present invention must have the charge-retaining property and hence, the toner preferably has resistivity of at least $10^{10}$ Ohm cm. Even if the resistivity of the toner is below this value, however, the toner can be charged by the method of the present invention in accordance with the degree of its charge-retaining property.

Since the toner or the toner and the carrier must jump during the above-mentioned charging process, it is sometimes effective to blend an additive for preventing aggregation such as fine silica powder or an additive for disintegrating the aggregate.

Next, the suitable condition for carrying out the above-mentioned charging process will be explained. From the condition in the developing process, the toner generally has a particle size of 0.1 to 100 microns and especially preferably, from 1 to 20 microns. In the charging space 3, the a.c. field is necessary which is at least sufficient for the toner particles to oscillate. The practical range of the a.c. field is preferably from $\pm 5\times 10^4$ to $5\times 10^6$ V/m. The voltage across the electrode plates 1A and 1B is lower than a voltage at which corona discharge occurs (generally, about $\pm 4$ KV), and the frequency is such that the toner particles are capable of following up the frequency. Generally, it is in the range of 50 Hz to 50 KHz and, preferably, from 300 Hz to 5 KHz.

The thickness of the charging space 3 is generally from 0.1 to 10 mm and the quantity of the toner to be introduced into the space is such that the oscillation of the toner particles is possible. It is generally a quantity not exceeding $\frac{2}{3}$ of the charging space 3.

Figure 2:
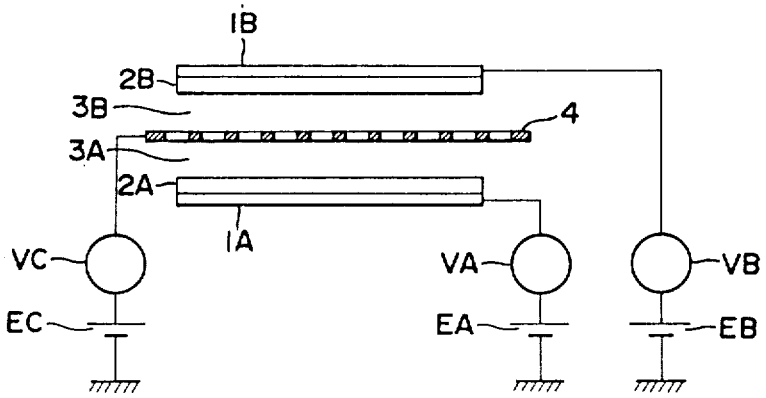
FIGS. 2 and 3 are schematic sectional views, each the charging device in another embodiment of the present invention.

FIG. 2 illustrates another example of the charging device that can be used for the above-mentioned charging process. In this embodiment, a screen grid 4 is interposed between a pair of charging members 2A and 2B opposing each other so as to form the charging spaces 3A and 3B that oppose the charging members 2A and 2B, respectively. An a.c. power source VC is connected to the charging spaces 3A and 3B in order to generate the a.c. field. If necessary, a superposing d.c. power source EC is further connected, thereby perfecting the charging device.

In this construction, the a.c. fields are generated in the charging spaces 3A and 3B where charging of the toner is effected in the same way as in the above-mentioned embodiment. In this case, the screen grid 4 may be furnished with the function of the charging member.

Figure 3:
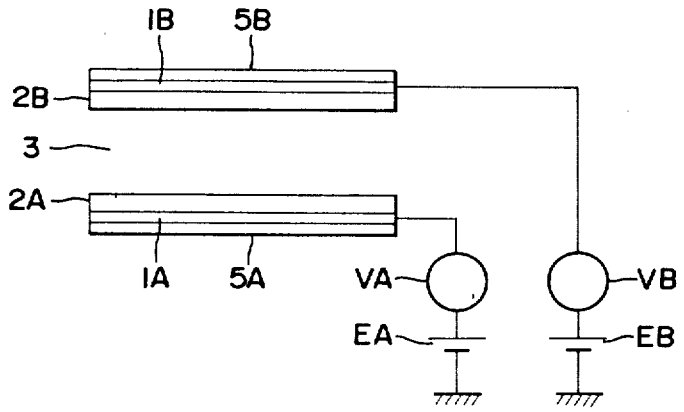

If the toner is a so-called "magnetic toner" containing a magnetic substance, it is possible to dispose magnets 5A and 5B outside the electrode plates 1A and 1B in this charging device as shown in FIG. 3, for example. It is further possible to form the electrode plates 1A, 1B by a magnetic substance or to form the charging members 2A, 2B by a magnetic substance, the charging members sometimes functioning also as the electrode plates 1A, 1B.

If the magnets 5A, 5B are disposed so as to permit the magnetic force to act upon the magnetic toner inside the charging space 3 in the above-mentioned manner, predetermined attraction with respect to the charging members 2A, 2B acts upon the toner so that the toner thickness can be rendered uniform even if it is non-uniform at the time of introduction, and the charging operation can be promoted when the toner particles impinge against the charging members 2A, 2B. Furthermore, the oscillating condition of the toner inside the charging space 3 can be made uniform throughout the entire charging space 3. It is possible to obtain the same action and effect as when the d.c. voltage is superposed, or the effect of adsorbing and retaining the charged toner, that has reached a predetermined charge quantity, on the charging member 2A or 2B by means of the attraction. This electric and magnetic force retaining the toner on one of the charging members can be commonly used as the bias force at the time of development.

As described above, in accordance with the present invention, the toner is suitably charged in the charging process and the charged toner can be obtained while being retained in the form of a layer having a uniform thickness on one of the charging members 2A, 2B by the electric and magnetic force. Accordingly, extremely excellent development can be accomplished by developing the electrostatic image using the toner layer.

In other words, since the charge quantity of the toner is controlled to a suitable level, the charging state is uniform and moreover, the polarity is the desired polarity, and the toner is allowed to attach only to the regions where the charge of the electrostatic image to be developed exists. Thus, there can be formed an extremely excellent visible image having high clarity, sufficiently high image density and devoid of variance of density. Because the toner can be retained in the layer form when it is transferred into the developing region, position control with respect to the electrostatic image support or the like can be easily made. For example, the relation with the electrostatic image support can be controlled accurately, thereby mitigating the strict condition imposed on the developing process. As the scattering of the toner is less, it is possible to prevent contamination of the electrostatic image support.

Since control of the charge quantity is possible as already described, it is easy to increase the amount of the developer per unit time that can be charged in a desired charged state. In conjunction with this advantage, high speed development can be carried out easily.

From the aspects described above, it is preferred and extremely advantageous in the present invention to construct the charging member 2A or 2B, that supports the charged toner layer thereon, so that it is capable of moving to the developing region from the charging space 3 for development.

Figure 4:
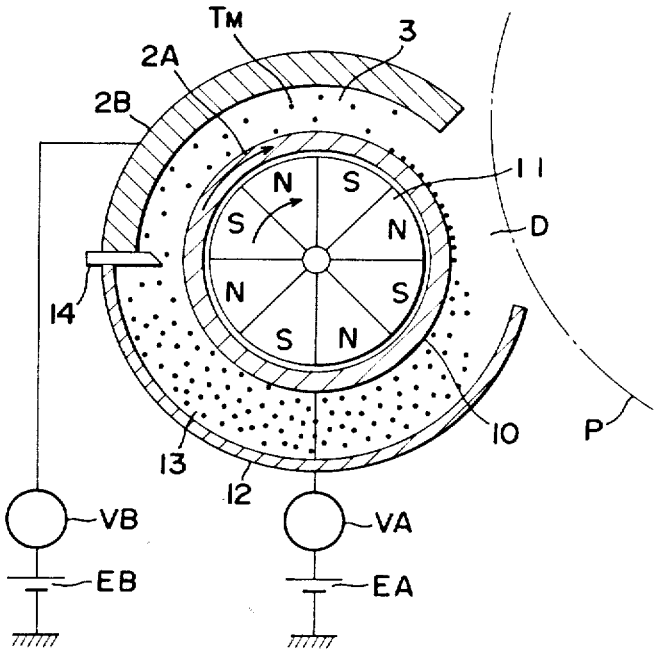
FIGS. 4 and 5 are schematic sectional views, each showing a developing machine suitably used for practising the method of the present invention.

FIG. 4 illustrates an example of a developing device for practising such a method. In this example, one of the charging member 2A is so constructed by a metal sleeve 10 as to serve also as the electrode and is supported so as to rotate in the direction indicated by an arrow. A magnetic roller 11 consisting of a magnet is rotatably disposed therein, and the other charging member 2B is disposed so as to oppose a part of the outer circumferential surface of the sleeve 10 via a charging space 3 having a uniform thickness. Symbol D represents a developing region downstream of the charging space 3 and symbol P an electrostatic image support. 12 represents a container member opposing the outer circumferential region of the sleeve 10 upstream of the charging space 3 and forming a toner tank 13. A toner introduction quantity limiter 14 is disposed at the boundary between the toner tank 13 and the charging space 3.

In the above-mentioned developing device, the magnetic toner TM filled fully into the toner tank 13 is transferred by the rotation of the sleeve 10 and by the magnetic force of the rotating magnetic roller 11 and the toner limited in the quantity by the toner introduction quantity limiter 14 is introduced into the charging space 3, where the toner is electrically charged in the same way as above. The toner thus charged is transferred from the charging space 3 to the developing region D while retained in the laminar form and is capable of developing the electrostatic image of the electrostatic image support P at a high developing speed. Incidentally, transfer of the developer may be effected either by the rotation of the magnetic roller or by the rotation of the sleeve alone.

As definite means for carrying out the developing process, various heretofore known means such as contact developing processes exemplified by a contact process, an impression process and the like or non-contact developing processes exemplified by a touch-down process, a jumping process and the like may be used.

As can be understood from the foregoing description, the magnetic toner is advantageous in that the toner can be transferred by use of the magnet and a toner brush can be easily formed in the developing process. Though the content of the magnetic substance in the magnetic toner varies depending upon its kind or the like, resistivity would lower generally if the content is great. In conjunction with this point, the magnetic toner that can be suitably used for practising the method of the present invention preferably has the content of the magnetic substance of up to 70% by weight. Incidentally, the content of the magnetic substance required for transfer is generally at least 10% by weight.

As described above, the present invention makes it possible to suitably charge the insulating one-component developer and to obtain the charged toner in an excellent condition by an extremely simple method. In the repeated development, too, the present invention makes it possible to advantageously carry out the development of the excellent electrostatic image and to form an excellent visible image.

Hereinafter, examples of the present invention will be described.

EXAMPLE 1

Figure 5:
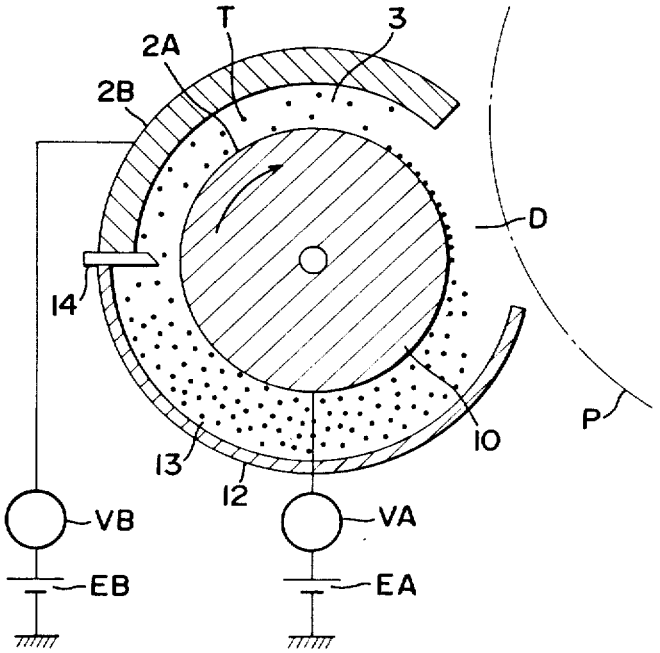

As shown in FIG. 5, a developing device was assembled by rotatably disposing an aluminum sleeve 10, and arranging a charging member 2B of an aluminum sheet in such a manner as to oppose the outer circumferential surface of the sleeve 10 via a 1 mm-thick charging space 3 so that a 0.1 mm-thick toner layer could be introduced into the charging space 3 by regulating a toner introduction quantity limiter 14. The developing device thus obtained was assembled into an electrophotographic copying machine "U-Bix V2" (a product of Konishiroku Photo Ind. Co., Ltd.) and an electric power was fed so as to rotate the sleeve 10 at a rate of 50 r.p.m. in the direction indicated by an arrow. An a.c. voltage 1.0 KV of 2 KHz frequency of an a.c. power source VA and a d.c. voltage +100V of a d.c. power source EA were also applied to the sleeve 10 so as to superpose with each other. In examples hereafter we use the sine wave type of a.c. In the condition where the a.c. power source VB for the charging member 2B was zero and the d.c. power source EB for the charging member 2B was −100V, an a.c. field was generated in the charging space 3 and in the developing region D. The gap between the sleeve 10 and the electrostatic image support D was set to 0.5 mm.

On the other hand,

| | |
|---|---|
| styrene-acrylic resin "SBM 73" (a product of Sanyo Kasei Kogyo K.K.) | 88 parts by weight |
| charge controlling agent "Varifast Black 3804" (a product of Orient Kagaku Kogyo K.K.) | 2 parts by weight |
| carbon black "MA-8" (a product of Mitsubishi Kasei Kogyo K.K.) | 10 parts by weight |

were melt-blended, pulverized and then classified to provide toner particles having an average particle size of 15 microns. A trace amount of fine silica powder was added to the toner particles and the mixture was fully charged into the toner tank 13 of the developing device. After the developing device was actuated, the toner was transferred by the sleeve via the charging space 3 and the charged toner layer having a uniform thickness was transferred onto the sleeve inside the developing region D. The charge quantity of the toner was measured by the blow-off method and was found to be −7 micro Coulomb/g.

Copying tests were carried out by actually developing an electrostatic image formed on the electrostatic image support consisting of a photosensitive material in the copying machine. It was found that a clear copy image devoid of fog and having a sufficient image density could be obtained.

Exactly the same procedures as above were followed except that the charging member 2B was removed, and the charge quantity of the toner transferred into the developing region D was measured. It was found to be −0.5 micro Coulomb/g. As a result of the similar copying test, the resulting copy image was found to have base contamination and could not provide an excellent image.

EXAMPLE 2

A developing device was assembled in accordance with the embodiment shown in FIG. 4 by placing a magnetic roller 11 inside a non-magnetic stainless steel sleeve 10 and disposing a charging member 2B so as to oppose the outer circumferential surface of the sleeve 10 via a 1.5 mm-thick charging space 3 so that a 0.3 mm-thick toner layer could be introduced into the charging space 3 by adjusting a toner introduction quantity limiter 14. The resulting developing device was assembled into an electrophotographic copying machine "U-Bix V2") (a product of Konishiroku Photo Ind. Co., Ltd.) and the magnetic roller 11 and the sleeve were rotated at rates of 1,000 r.p.m. and 40 r.p.m., respectively, in the direction indicated by an arrow. An a.c. voltage 1.5 KV of 2 KHz frequency was applied from the a.c. power source VB to the charging member 2B and +100V d.c. voltage was applied from the d.c. power source EA to the sleeve 10. In the condition in which the voltage of the a.c. power source VA for the sleeve 10 and the d.c. voltage of the d.c. power source EB for the charging member 2B were held at zero, respectively, the a.c. field was generated inside the charging space 3. The gap between the sleeve 10 and the electrostatic image support P was set to 0.2 mm.

On the other hand,

| | |
|---|---|
| styrene-acrylic resin "SBM 73" (a product of Sanyo Kasei Kogyo K.K.) | 60 parts by weight |
| magnetite "EPT 1000" (a product of Toda Kogyo K.K.) | 37 parts by weight |
| charge controlling agent "Varifast Black 3804" (a product of Orient Kagaku Kogyo K.K.) | 1 parts by weight |
| carbon black "MA-8" (a product of Mitsubishi Kasei Kogyo K.K.) | 2 parts by weight |

were melt-blended, pulverized and then classified to provide toner particles having an average particle size of 15 microns. A trace amount of fine silica powder was added to the toner particles and the toner was fully charged into the toner tank of the developing device 13. After the developing device was actuated, the toner was transferred by the sleeve via the charging space 3 and the charged toner layer having a uniform thickness was transferred onto the sleeve in the developing region D. When the charge quantity of this toner was measured by the blow-off method, it was found to be −9 micro Coulomb/g.

Copying tests were carried out by actually developing the electrostatic image formed on the electrostatic image support consisting of a photosensitive material in the copying machine, and a clear copy image devoid of fog and having a sufficiently high image density could be obtained.

In contrast, exactly the same procedures as above were followed except that the voltage of the a.c. power source VB for the charging member 2B was made zero and no a.c. field was generated, and the charge quantity of the charged toner transferred into the developing region D was measured. It was found to be −1 micro Coulomb/g. When the similar copying test was carried out, the resulting copy image had base contamination and an excellent copy image could not be obtained.

EXAMPLE 3

A developing device was assembled in accordance with the embodiment shown in FIG. 4 by placing a magnetic roller 11 in a non-magnetic stainless steel sleeve 10 and disposing a charging member 2B consisting of an aluminum sheet so as to oppose the outer circumferential surface of the sleeve 10 via a 1.5 mm-thick charging space 3 so that a 0.3 mm-thick toner layer could be introduced into the charging space 3 by adjusting a toner introduction quantity limiter 14. The resulting developing device was assembled into an electrophotographic copying machine "U-Bix V2" and the magnetic roller 11 and the sleeve were rotated at rates of 1,000 r.p.m. and 40 r.p.m., respectively, in the direction indicated by the arrow. An a.c. voltage 1.5 KV of 2 KHz frequency of the a.c. power source VA and a d.c. voltage +100V of the d.c. power source EA were superposed with each other and were applied to the sleeve 10. In the condition in which the a.c. voltage VB and the d.c. voltage EB for the charging member 2B were kept zero, the a.c. field was generated in the charging space 3 and in the developing region D. The gap between the sleeve 10 and the electrostatic image support P was set to 0.5 mm.

On the other hand,

| | |
|---|---|
| styrene-acrylic resin "SBM 73" (a product of Sanyo Kasei Kogyo K.K.) | 60 parts by weight |
| magnetite "EPT 1000" (a product of Toda Kogyo K.K.) | 37 parts by weight |
| charge controlling agent "Varifast Black 3804" (a product of Orient Kagaku Kogyo K.K.) | 1 parts by weight |
| carbon black "MA-8" (a product of Mitsubishi Kasei Kogyo K.K.) | 2 parts by weight |

were melt-blended, pulverized and classified to provide toner particles of an average particle size of 15 microns. A trace amount of fine silica powder was added, and the toner was fully charged into the toner tank 13 of the developing device. After the developing device was actuated, the toner was transferred onto the sleeve via the charging space and the charged toner layer having a uniform thickness was transferred to the sleeve in the developing region. When the charge quantity of this toner was measured by the blow-off method, it was found to be −9 micro Coulomb/g.

When a copying test was carried out by actually developing the electrostatic image formed on the electrostatic image support consisting of a photosensitive material in the copying machine, a clear copy image devoid of fog and having a sufficient image density could be obtained.

By contrast, exactly the same procedures as above were followed except that the charging member 2B was removed, and the charge quantity of the charged toner transferred into the developing region D was measured. It was found to be −1 micro Coulomb/g and the resulting copy image had base contamination. Thus, an excellent copy image could not be obtained.

EXAMPLE 4

As illustrated in FIG. 3, charging members 2A and 2B, each consisting of an aluminum sheet and serving also as an electrode plate, were arranged to oppose each other to form a charging device having a 1.5 mm-thick charging space 3. Using the charging device, the toner was placed on the lower charging member 2A so that the thickness of the toner layer was about 0.2 mm. The toner used hereby was obtained by the following method.

| | |
|---|---|
| styrene-acrylic resin "SBM 73" (a product of Sanyo Kasei Kogyo K.K.) | 60 parts by weight |
| magnetite "EPT-1000" (a product of Toda Kogyo K.K.) | 37 parts by weight |
| charge controlling agent "Varifast Black 3804" (a product of Orient Kagaku Kogyo K.K.) | 1 parts by weight |
| carbon black "MA-8" (a product of Mitsubishi Kasei Kogyo K.K.) | 2 parts by weight |

were melt-blended, pulverized and classified to provide toner particles having an average particle size of 15 microns, and a trace amount of fine silica powder was added.

An a.c. voltage 1.0 KV of 2 KHz of the a.c. power source VA and a +200 d.c. voltage of the d.c. power source EA were superposed with each other and were then applied to the charging member 2A. In the condition in which the a.c. power source VB for the other charging member 2B and the voltage of the d.c. power source for the same were held at zero and −100V, respectively, the a.c. field was generated inside the charging space 3 and was permitted to act upon the toner for the period of 10 seconds.

During these operations, occurrence of the toner cloud was first observed and the charged toner layer having a uniform thickness was then formed on the charging member 2A.

The charge quantity of the charged toner obtained in this manner was measured by the blow-off method and was found to be −12 micro Coulomb/g. This was sufficient to develop an electrostatic image formed by an ordinary electrophotographic process, for example.

EXAMPLE 5

As illustrated in FIG. 2, charging members 2A and 2B, each consisting of brass sheet and serving also as an electrode plate, were arranged parallel with a 4 mm gap between them so as to oppose each other. A 200-mesh screen grid 4 consisting of stainless steel was interposed between and at the center of the charging members 2A and 2B and magnets were disposed outsides the outer surfaces of the charging members 2A, 2B, respectively, thereby forming a charging device. Using this charging device, the same toner as in Example 1 was placed on one 2A of the charging members so that its thickness was about 0.1 mm.

An a.c. voltage 1.0 KV of 1 KHz frequency of the a.c. power source VC and a −100V d.c. voltage of the d.c. power source EC were superposed with each other and were applied to the screen grid 4. The a.c. voltages of the power sources VA, VB for the charging members 2A, 2B and the voltage of the d.c. power source EB for the charging member 2B were all kept zero, and a +200V d.c. voltage of the d.c. power source EA was applied to the charging member 2A so as to generate the a.c. fields inside the charging spaces 3A and 3B and the fields were permitted to act upon the toner T for the period of 15 seconds.

During these operations, occurrence of the toner cloud was first observed and the charged toner layer having a uniform thickness was then formed on the charging member 2A.

The charge quantity of the charged toner obtained in this manner was measured by the blow-off method and was found to be −9 micro Coulomb/g. This was sufficient to develop the electrostatic image formed by an ordinary electrophotographic process, for example.

EXAMPLE 6

As illustrated in FIG. 4, a charging device was assembled by placing a magnetic roller 11 inside a non-magnetic stainless steel sleeve 10 and disposing a charging member 2B consisting of an aluminum sheet so as to oppose the outer circumferential surface of the sleeve 10 via a 1.5 mm-thick charging space 3 so that a 0.3 mm-thick toner layer could be introduced into the charging space 3 by adjusting a toner introduction quantity limiter 14. The magnetic roller 11 and the sleeve were rotated at the rates of 1,000 r.p.m. and 40 r.p.m., respectively, in the direction indicated by the arrow. An a.c. voltage 1.5 KV of 2 KHz frequency of the a.c. power source VB was applied to the charging member 2B and a +100V d.c. voltage of the d.c. power source EA was applied to the sleeve 10. The voltage of the d.c. power source VA for the sleeve 10 and the voltage of the d.c. power source EB for the charging member 2B were kept zero so as to generate the a.c. field inside the charging space 3.

The same toner as used in Example 1 was fully charged into the toner tank 13 and was introduced into the charging space 3, whereby the charged toner layer having a uniform thickness could be formed on the outer circumferential surface of the sleeve 10 extending out of the charging space 3. When the charge quantity of the charged toner was measured by the blow-off method, it was found to be −9 micro Coulomb/g.

By contrast, exactly the same procedures as above were followed except that the voltage of the a.c. power source VB for the charging member 2B was kept zero and the a.c. field was not generated, and the charge quantity of the toner on the outer circumferential surface of the sleeve 10 extending out of the charging space 3 was measured by the same measuring method. It was found to be −1 micro Coulomb/g.

From these results, too, it is obvious that in accordance with the present method, the toner could be reliably and sufficiently charged by the action of the a.c. field.

EXAMPLE 7

As illustrated in FIG. 3, charging members 2A and 2B, each consisting of an aluminum sheet and serving also as an electrode plate, were disposed parallel so as to oppose each other and to define a 2 mm-thick charging space 3 between them. Using the charging device thus formed, a two-component developer was placed on the lower charging member 2A so that the thickness of its layer became 1 mm. The developer used hereby was for use in an electrophotographic copying machine, "U-Bix V3" (a product of Konishiroku Photo Ind. Co., Ltd.) and was composed of a toner consisting of a styrene-acrylic copolymer and containing therein carbon black and a carrier consisting of iron powder.

An a.c. voltage 2.0 KV of 2.0 KHz frequency of the a.c. power source VA and a +200V d.c. voltage of the d.c. power source EA were superposed with each other and were applied to the charging member 2A, and the voltage of the a.c. power source VB for the other charging member 2B and the voltage of the d.c. power source EB for the same were held at the ground potential so as to generate the a.c. field inside the charging space 3. The a.c. field was permitted to act upon the toner for the period of 10 seconds.

During these operations, occurrence of the toner cloud was first observed and the developer layer containing the charged toner and having a uniform thickness was then formed on the charging member 2A.

The charge quantity of the charged toner thus obtained was measured by the blow-off method and was found to be −12 micro Coulomb/g. This was sufficient to develop the electrostatic image formed by an ordinary electrophotographic process, for example.

EXAMPLE 8

As illustrated in FIG. 2, charging members 2A and 2B, each consisting of a brass sheet and serving also as an electrode plate, were arranged in parallel with a 5 mm gap between them. A 50-mesh screen grid 4 consisting of stainless steel was interposed between and at the center of the charging members 2A and 2B, and magnets were disposed outside the outer surfaces of the charging members 2A, 2B, thereby forming a charging device. Using this charging device, a developer for use in an electrophotographic copying machine, "U-Bix 2000R" (a product of Konishiroku Photo Ind. Co., Ltd.), composed of a toner consisting of a styrene-acrylic copolymer and an iron powder carrier, was placed on one 2A of the charging members so that the thickness of its layer became 1 mm.

An a.c. voltage 3.0 KV of 500 Hz frequency of the a.c. power source VC and a +150V d.c. voltage of the d.c. power source EC were applied to the screen grid 4, and the voltages of the a.c. power sources VA, VB for the charging members 2A, 2B and the voltage of the d.c. power source EB for the charging member 2B were all held zero. A −200V d.c. voltage of the d.c. power source EA was applied to the charging member 2A so as to generate the a.c. fields inside the charging spaces 3A, 3B and the fields were permitted to act upon the toner T for the period of 15 seconds.

During these operations, occurrence of the toner cloud was first observed and a developer layer containing the charged toner of a uniform thickness was then formed on the charging member 2A.

The charge quantity of the charged toner thus obtained was measured by the blow-off method and was found to be 8 micro Coulomb/g, and was sufficient to develop an electrostatic image formed by an ordinary electrophotographic process, for example.

EXAMPLE 9

Figure 6:
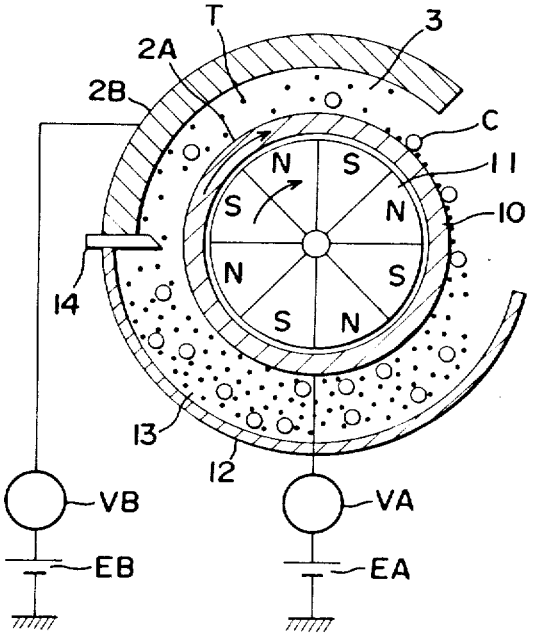
FIG. 6 is a schematic view when a two-component developer is employed.

As illustrated in FIG. 6, a magnetic roller 11 was placed inside a non-magnetic stainless steel sleeve 10, and a charging member 2B consisting of an aluminum sheet was disposed so as to oppose the outer circumferential surface of the sleeve 10 via a 4 mm-thick charging space 3, so that a 1 mm-thick developer layer could be introduced into the charging space 3 by adjusting a developer introduction quantity limiter 14. Using the charging device thus formed, the magnetic roller 11 and the sleeve 10 were rotated at the rates of 1,000 r.p.m. and 100 r.p.m., respectively, in the direction indicated by the arrow. An a.c. voltage 1.5 KV of 2 KHz frequency of the a.c. power source VB was applied to the charging member 2B while a +100V d.c. voltage of the d.c. power source EA was applied to the sleeve 10. The voltage of the a.c. power source VA for the sleeve 10 and the voltage of the d.c. power source EB for the charging member 2B were held zero so as to generate an a.c. field inside the charging space 3.

The same developer as used in Example 1 fully charged into the developer tank 13 was introduced into the charging space and the developer layer containing the charged toner and having a uniform thickness could be formed on the outer circumferential surface of the sleeve 10 extending out from the charging space 3. When the charge quantity of the charged toner was measured by the blow-off method, it was found to be −9 micro Coulomb/g.

By contrast, exactly the same procedures as above were followed except that the voltage of the a.c. power source VB for the charging member 2B was held zero and no a.c. field was generated. When the charge quantity of the toner on the outer circumferential surface of the sleeve 10 extending out from the charging space 3 was measured by the blow-off method, it was found to be −2 micro Coulomb/g.

From these results, too, it is obvious that in accordance with the present method, the toner could be reliably and sufficiently be charged.

EXAMPLE 10

As illustrated in FIG. 6, a magnetic roller 11 was placed inside a non-magnetic stainless steel sleeve 10 and a charging member 2B consisting of an aluminum sheet was disposed so as to oppose the outer circumferential surface of the sleeve 10 via a 1.5 mm-thick charging space 3, so that a 1 mm-thick developer layer could be introduced into the charging space 3 by adjusting a developer introduction quantity limiter 14. A charging device formed in this manner was assembled into an electrophotographic copying machine, "U-Bix V3" (a product of Konishiroku Photo Ind. Co., Ltd.), and the magnetic roller 11 and the sleeve were rotated at the rates of 1,000 r.p.m. and 40 r.p.m., respectively, in the direction indicated by the arrow. An a.c. voltage 1.5 KV of 2 KHz frequency of the a.c. power source VB was applied to the charging member 2B and a +100V d.c. voltage of the d.c. power source EA was applied to the sleeve 10. In the condition in which the voltage of the a.c. power source VA for the sleeve 10 and the voltage of the d.c. power source EB for the charging member 2B were held zero, an a.c. field was generated inside the charging space 3. The gap between the sleeve 10 and the electrostatic image support P was set to 0.7 mm.

A two-component developer for use in the electrophotographic copying machine "U-Bix V3", composed of a toner consisting of a styrene-acrylic copolymer and an iron powder carrier was fully charged into the developer tank 13 and was transferred by the sleeve via the charging space 3 after actuating the developing machine. In the developing region D, a developer layer containing the charged toner on the sleeve and having a uniform thickness could be transferred. The charge quantity of the toner was measured by the blow-off method and was found to be −9 micro Coulomb/g.

When a copying test was carried out by actually developing the electrostatic image formed on the electrostatic image support consisting of a photosensitive material in the copying machine, a clear copy image devoid of fog and having a sufficiently high image density could be obtained.

By contrast, exactly the same procedures as above were carried out except that the voltage of the a.c. power source VB was kept zero and no a.c. field was generated. When the charge quantity of the charged toner transferred into the developing region D was measured, it was found to be −2 micro Coulomb/g. The resulting copy image had base contamination and hence, an excellent copy image could not be obtained.

EXAMPLE 11

As illustrated in FIG. 6, a magnetic roller 11 was placed inside a non-magnetic stainless steel sleeve 10 and a charging member 2B consisting of an aluminum sheet was disposed so as to oppose the outer circumferential surface of the sleeve 10 via a 1.5 mm-thick charging space 3, so that a 1 mm-thick developer layer could be introduced into the charging space 3 by adjusting a developer introduction quantity limiter 14. A developing machine thus formed was assembled into an electrophotographic copying machine, "U-Bix V3" (a product of Konishiroku Photo Ind. Co., Ltd.). The magnetic roller 11 and the sleeve were rotated at the rates of 1,000 r.p.m. and 40 r.p.m., respectively, in the direction indicated by the arrow. An a.c. voltage 1.5 KV of 2 KHz frequency of the a.c. power source VA and a +100V d.c. voltage of the d.c. power source EA were superposed with each other and were applied to the sleeve 10. In the condition in which the voltages of both a.c. and d.c. power sources VB and EB for the charging member 2B were held zero, the a.c. fields were generated inside the charging space 3 and inside the developing region D. The gap between the sleeve 10 and the electrostatic image support P was set to 1.5 mm.

A two-component developer for use in the electrophotographic copying machine "U-Bix V3", composed of a toner consisting of a styrene-acrylic copolymer and an iron powder carrier, was fully charged into the developer tank 13, and was transferred by the sleeve via the charging space 3 after actuating the developing machine. Inside the developing region D, the developer layer containing the charged toner on the sleeve and having a uniform thickness was transferred. The charge quantity of this toner was measured by the blow-off method and found to be −9 micro Coulomb/g.

When a copying test was carried out by developing the electrostatic image formed on the electrostatic image support consisting of a photosensitive material in the copying machine, a clear copy image devoid of fog and having a sufficiently high image density could be obtained.

By contrast, exactly the same procedures as above were followed except that the charging member 2B was removed. When the charge quantity of the charged toner transferred into the developing region D was measured, it was found to be −2 micro Coulomb/g. The resulting copy image had base contamination and an excellent copy image could not be obtained.

Figure 7:
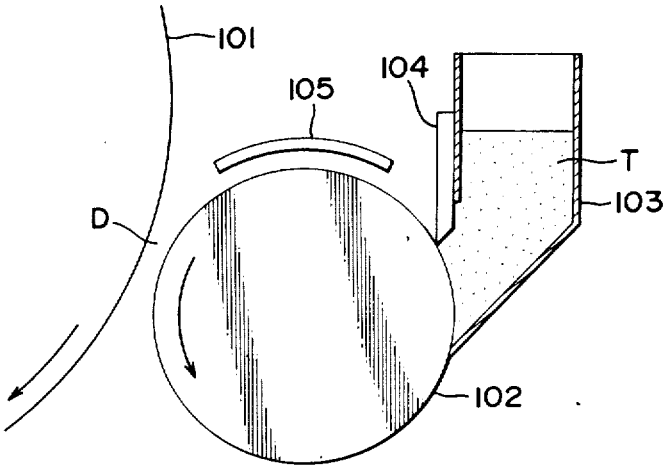
FIG. 7 is a schematic view showing another example of the device used for the electrostatic image developing method of the present invention.
Figure 8:
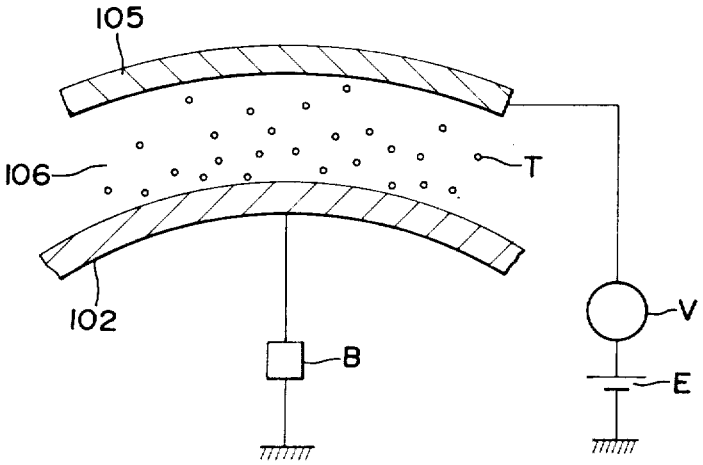
FIG. 8 is an enlarged schematic view of the device of FIG. 7.

FIG. 7 illustrates another example of the device used for practising the method of the present invention. In this example, a rotary sleeve 102 made of a metal is placed in such a manner as to oppose the outer circumferential surface of a rotary drum type photosensitive member 101 forming the electrostatic image support, and a developer hopper 103 for feeding an insulating one-component developer (hereinafter simply called "toner T") was disposed on this sleeve 102. A toner quantity limiter 104 and a charging member 105 of an electroconductive material, for example, are then disposed between the developer hopper 103 and the photosensitive member 101 along the rotating direction of the sleeve 102, in order named, thereby forming the charging device. In this case, the charging member 105 is disposed in such a manner as to define a charging space 106 of a uniform thickness between it and the sleeve 102. An a.c. field is generated inside the charging space 106 by, for example, connecting an a.c. power source V or the a.c. power source V in combination of a positive or negative d.c. power source E ranging from 0 to about 300V for preventing deposition of the toner to the charging member 105.

Using the device having the construction described above, the electrostatic image is developed in the present invention in the following manner.

The sleeve 102 is rotated in the opposite direction to the photosensitive member 101 so that it advances in the same direction as the photosensitive member 101 inside the developing region D, and the toner T charged into the hopper 103 is fed to, and transferred by, the sleeve 102. The toner T in an amount regulated by the toner quantity limiter 104 is then introduced into the charging space 106 in which the a.c. field is generated by the a.c. power source V and the toner particles of the toner T are oscillated in this charging space 106 so as to form the toner cloud.

As will be described hereafter, the charged toner layer formed on the outer circumferential surface of the sleeve 102 is then transferred into the developing region D where the sleeve 102 opposes or comes into contact with the photosensitive member 101. Inside this developing region D, the electrostatic image that is supported on the photosensitive member 101 is developed by non-contact or contact type developing means.

Here, as the developing means of the non-contact system developing means, it is possible to employ means for applying a d.c. bias voltage of 0 to about ±300V to the sleeve 101, whenever necessary, in order to invalidate the background potential other than the image on the electrostatic image during development, or means for applying an oscillating voltage of 50 Hz to 50 KHz frequency and 0V to 2 KV voltage (such as disclosed in U.S. Pat. No. 3,866,574 or in Japanese Patent Laid-Open No. 18656/1980, for example). In the drawing, symbol B represents this bias power source. In the non-contact developing system, the closest gap between the surface of the photosensitive member 101 and the toner layer during their mutual approach is generally set to 1 mm or below. In the contact developing system, further, it is preferred that the sleeve 102 comes into resilient contact with the photosensitive member 101 but does not damage the latter.

In the example shown in FIG. 7, the rotating direction of the sleeve 102 may be such that its advancing direction in the developing region D may be opposite the photosensitve member 101.

In the method of the present invention described above, the toner is electrically charged as it travels through the charging space 106 and the charging mechanism is assembled as follows. First, since the toner T is powdery, it is charged even slightly under the natural state. Even if it is not charged at all, the toner is charged due to the mutual friction between the toner particles or to the friction with respect to the device wall, and so forth.

Because the toner T is charged even though it is only slight, the Coulomb force acts upon the toner T if the electric field acts upon the toner so that the toner T oscillates in accordance with the alternating oscillation of the field. In other words, the toner particles project through the charging space 106 towards the sleeve 102 or the charging member 105, impinge against it, then project backward in the next half period and impinge against the charging member 105 or the sleeve 102, thereafter repeating the same behavior. Under this state, the toner cloud is formed, The toner particles are electrically charged due primarily to the friction when they impinge against the sleeve 102 or the charging member 105 or due to the mutual friction of the toner particles during their projection. Thus, the sleeve 102 functions as one of the charging members.

The charge polarity of the toner T is determined by the relation in the frictional charge sequence between the materials of the sleeve 102 and charging member 105 and the toner T. Accordingly, by selecting the materials for the sleeve 102 and charging member 105 or the material of the toner itself so that they have the relative sequence relation required for toner charging, the toner T can be charged in the polarity determined by the selection of the materials. The charged toner is attracted on the surface of the sleeve 102 or charging member 105 in the laminar form due to its electrostatic force. Accordingly, as described already, by superposing the d.c. voltage with the a.c. voltage for forming the a.c. field, it is possible to reliably adsorb and retain the charged toner T in a predetermined charge quantity on the sleeve 102 by using the attraction or repulsion. As the charging operation is not effected any longer to the toner particles thus adsorbed, the toner is after all charged in a predetermined charge quantity.

It is practically necessary that at least a part of the sleeve 102 and charging member 105 be made of an electrically conductive material in order to maintain electric equilibrium between charge generated on the sleeve 102 or the charging member 105 and the toner T upon its impingement against the former. As a result, further deposition of the charge on the sleeve or the charging member can be prevented and the desired behavior of the toner is not restricted. In this respect, it is preferred to form the sleeve 102 and the charging member 105 by a metal so as to use them as the electrode plates. It is also possible to form them by a substrate forming the electrodes and a surface layer facing the charging space 106.

Inside the charging space 106, the toner T is oscillated by the operation of the a.c. field and is charged. For this reason, the toner particles introduced into the charging space 106 are subjected to the substantially uniform action, so that all the toner particles are electrically charged with a high level of uniformity. If the charging member 105 is disposed in parallel to the sleeve 102 and the thickness of the charging space 106 is kept uniform as described already, the charging operation is effected uniformly throughout all the portions of the charging space 106 and thus, the charge quantity of the toner T can be made uniform in a reliable manner.

In the above-mentioned charging process, the number of impingement of the toner particles against the sleeve 102 or charging member 105 per unit time and their impinging speed depend upon the frequency and voltage of the a.c. power source V that generates the a.c. field. Accordingly, the charging speed of the toner or its charge quantity within a predetermined charging period can be easily controlled by controlling the a.c. frequency and voltage. Thus, the charge quantity required for the subsequent developing process can be obtained within a short period.

In the above-mentioned charging process, furthermore, the charged toner T can be permitted to attach onto the outer circumferential surface of the sleeve 102 by means of its electrostatic force and moreover, in a laminar form of a uniform thickness. This is accomplished because the uniform charging operation is effected inside the charging space 106 and because the toner T is charged in a uniform charge quantity, as described already. It is of course preferred that the quantity of the toner T to be introduced into the charging space 106 be always constant and to accomplish this object, the toner introduction quantity limiter 104 is employed. It is not necessary, however, that the toner T introduced into the charging space 106 is formed in a laminar form of a uniform thickness by this limiter 104. This is because the toner particles are charged while projecting and because the charging operation inside the charging space 106 is uniform, the charged toner T attaches onto the sleeve 102 as a uniform layer, even though the layer of the toner T introduced is not uniform.

The charged toner layer is then transferred into the developing region D, in which the toner projects while opposing the photosensitive member 101 and attaches to the electrostatic charge on the photosensitive member due to the electrostatic attraction, thereby developing the electrostatic image.

In the present invention, the toner transferred into the developing region D has a sufficiently large charge quantity and the charged toner on the sleeve 102 is in the layer form having a uniform thickness. In addition, the gap between the toner layer and the photosensitive member 101 can be reliably controlled to a preferred range (generally from 20 to 500 microns). For these reasons, the electrostatic image on the photosensitive member 101 can be developed reliably and easily and consequently, a satisfactory visible image can be formed stably.

Since the charge quantity of the toner can be rendered uniform, almost all the toner transferred to the developing region D can participate in development. By use of the toner introduction quantity limiter 104, therefore, the thickness, or the quantity, of the charged toner layer transferred into the developing region D can be controlled to a sufficient quantity required for development and occurrence of fog can be prevented, thereby providing an excellent visible image.

Furthermore, since the necessary charging of the toner can be made at a high speed, high speed development can be sufficiently realized by making use of a high frequency voltage such as 0V to 2 KV voltage of 50 Hz to 50 KHz frequency, for example.

The voltage across the sleeve 102 and the charging member 105 is lower than the voltage at which the corona discharge occurs (generally about ±4 KV) and the frequency is such that the toner particles are capable of following up the frequency. It is generally from 50 Hz to 50 KHz and more preferably, from 300 Hz to 5 KHz.

The thickness of the charging space 106 is generally from 0.1 to 10 mm, and the quantity of the toner introduced into the charging space is preferably such that the resulting toner layer is from about 1 to about 500 micron-thick.

Figure 9:
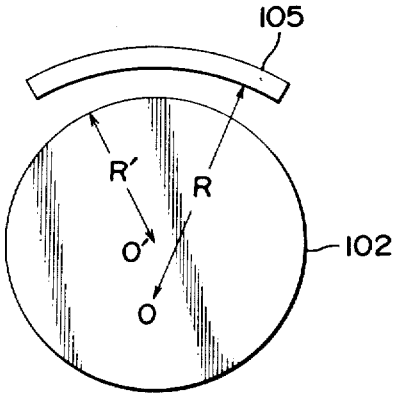
FIGS. 9 and 10 are schematic views, each showing a preferred example of charging members.
Figure 10:
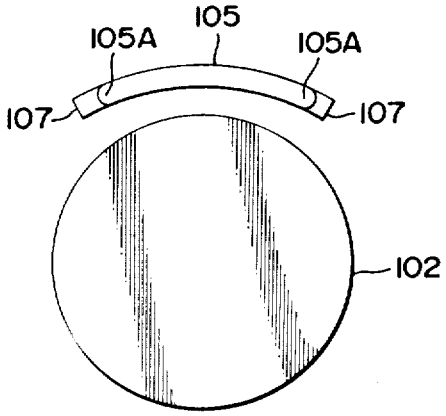

As for the charging member 105, discharge or breakdown is likely to occur especially between its end portion and the sleeve 102. In order to prevent such a problem, it is effective to form the charging member 105 in such a fashion that it is progressively spaced apart from the sleeve 102 from the center towards both of its ends as shown in FIG. 9, or to position the center O of the charging member 105 far away from the center O' of the sleeve 102 and to have its radius R greater than the radius R' of the sleeve 102. Alternatively, both end portions 105A, 105A of the charging member 105 may be rounded as shown in FIG. 10 or both end portions may be covered with insulating materials 107, 107.

In order to prevent the toner T, that has projected inside the charging space 106, from scattering outside and reaching the back of the charging member 105, it is preferred to dispose a shield plate so as to cover the space between the toner quantity limiter 104 and the charging space 106.

Transfer of the toner by the sleeve 102 is effected by utilizing the attraction due to the frictional charge of the toner or by utilizing the frictional force by making the surface of the sleeve 102 rough. Alternatively, it can be effected by use of a brush or a method disclosed in U.S. Pat. No. 3,866,574. During this transfer, it is sometimes effective to impress a d.c. or a.c. voltage upon the sleeve 102.

Figure 11:
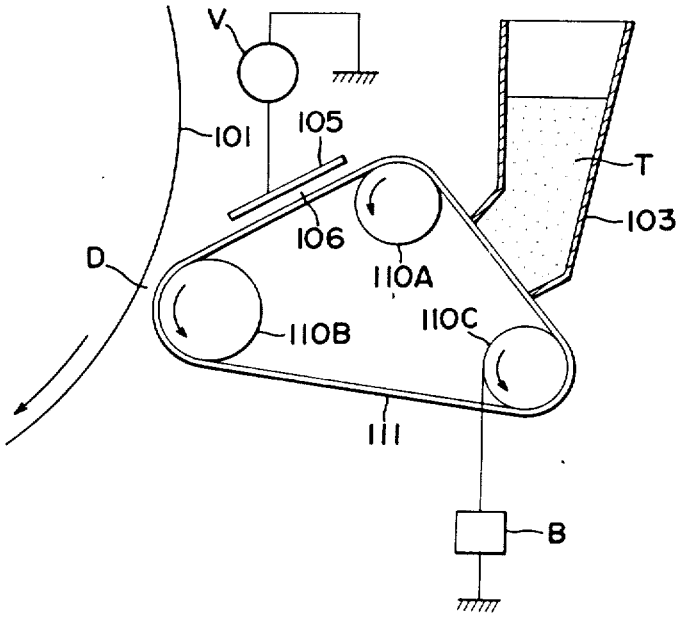
FIGS. 11 through 13 are schematic views, each showing the construction of another device to be employed in practising the method of the present invention.
Figure 12:
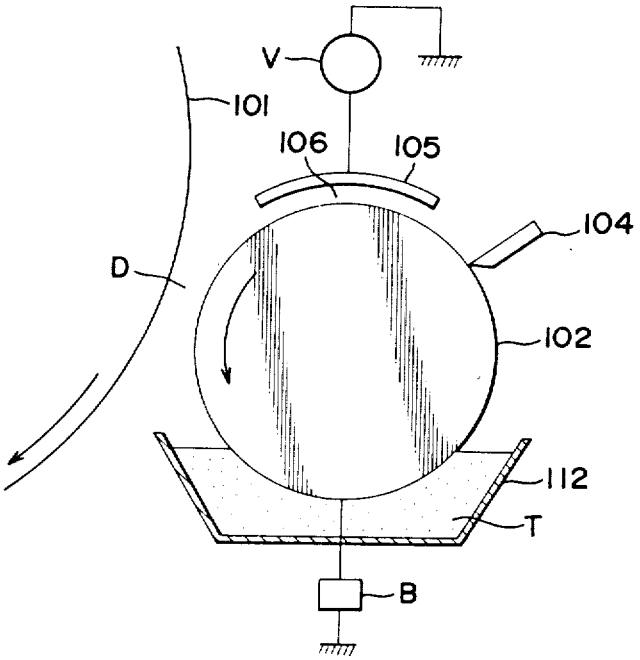

FIG. 11 illustrates still another example of the device that can be used for practising the method of the present invention. In this example, there is employed an electrically conductive belt 111 spread over three rollers 110A, 110B and 110C in place of the sleeve 102 in the device shown in FIG. 7. As shown in FIG. 12, the developer hopper 103 can be replaced by the toner tank 112. Symbol B represents a bias power source for development.

Figure 13:
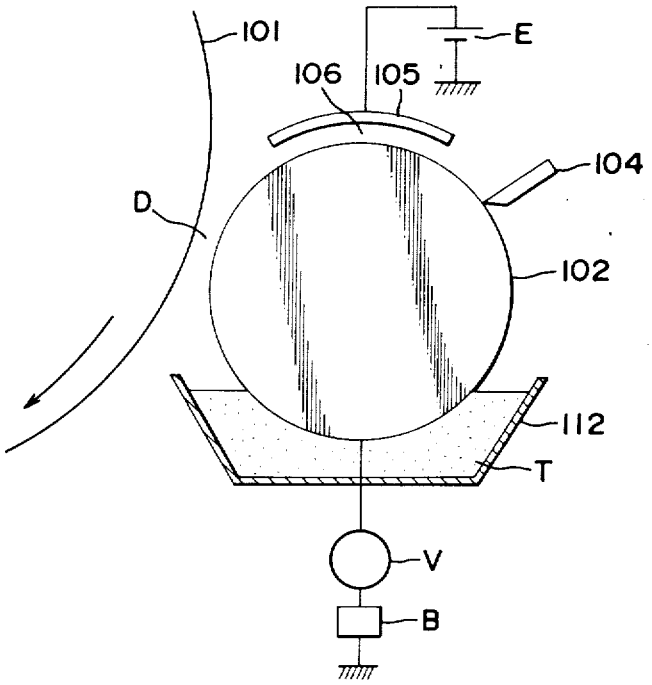

FIG. 13 illustrates an example in which the a.c. power source for generating the a.c. field is connected to the sleeve 102 in place of the charging member 105. In this construction, the a.c. power source and the bias power source B can be superposed, whenever necessary, in the developing means.

Figure 14:
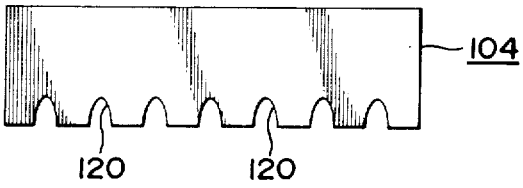
FIGS. 14 through 17 are schematic views, each showing a definite example of a toner quantity limiting member.
Figure 15:
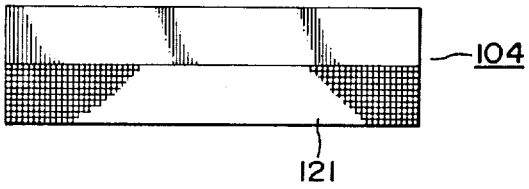
Figure 16:
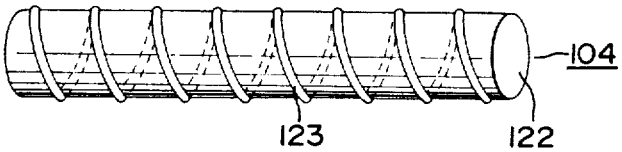
Figure 17:
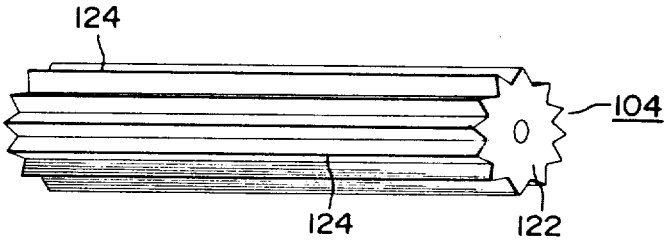

The toner quantity limiter 104 generally has a knife edge. Besides such a limiter, those shown in FIGS. 14 through 17 can also be used. One shown in FIG. 14 has a sheet-like shape and a number of slits 120 are formed at its tip. The limiter shown in FIG. 15 has a net 121 at the tip of a sheet-like member. The limiter shown in FIG. 16 has helical protuberances 123 around the outer circumference of a rotary rod 122 while one shown in FIG. 17 has protuberances 124 extending in the longitudinal direction on the outer circumferential surface of a rotary rod 122. Both are rotated and restrict the toner introduction quantity. A magnetic blade such as one disclosed in Japanese Patent Publication No. 93177/1980 can also be used.

As described in detail in the foregoing, the present invention makes it possible to develop easily and reliably the electrostatic image by making use of the insulating one-component developer or two-component developer in accordance with the non-contact or contact developing system and to obtain an excellent visible image.

What is claimed is:

1. A method for developing an electrostatic latent image on the surface of an electrostatic image support member which comprises:

(i) forming an electrostatic latent image on said surface of the electric image support member, (ii) transferring electrostatically charged developer which comprises a toner and a magnetic carrier which is coated with an insulating resin on the surface of a developer transfer member into a developing region by the relative movement between a magnet positioned in said developer transfer member and said developer transfer member, and (iii) applying an a.c. field between said electrostatic image support member and said developer transfer member so as to develop said electrostatic latent image in accordance with a non-contact developing system.

2. A method for developing an electrostatic latent image of claim 1, wherein said developer transfer member is arranged in relation to said electrostatic image support member so as to have a clearance between said surface of the electrostatic image support member and top of the developer layer on the surface of said developer transfer member.

3. A method for developing an electrostatic latent image of claim 1 wherein said toner is an insulating toner.

4. A method for developing an electrostatic latent image of claim 1, wherein said carrier is an insulating carrier.

5. A method for developing an electrostatic latent image of claim 1, wherein the step of applying a.c. field comprises superposing a d.c. field.

6. A method for developing an electrostatic latent image of claim 1, wherein said magnet is arranged so as to be rotatable.

7. A method for developing an electrostatic latent image of claim 2 wherein said magnet is arranged so as to be rotatable.

8. A method for developing an electrostatic latent image of claim 5 wherein said magnet is arranged so as to be rotatable.

* * * * *